United States Patent [19]

Scharer

[11] Patent Number: 5,051,050

[45] Date of Patent: Sep. 24, 1991

[54] CARTRIDGE SYSTEM FOR TOOL INSERTION TYPE BINDING MACHINE

[75] Inventor: Roger M. Scharer, Des Plaines, Ill.

[73] Assignee: General Binding Corporation, Northbrook, Ill.

[21] Appl. No.: 481,857

[22] Filed: Feb. 20, 1990

[51] Int. Cl.[5] ..... B42B 5/10; B42F 13/10

[52] U.S. Cl. ..... 412/40; 412/7; 412/12; 412/13; 281/15.1; 281/21.1; 281/27.2

[58] Field of Search ..... 281/15.1, 21.1, 27, 281/27.1, 27.2; 412/7, 11, 12, 13, 40, 43

[56] References Cited

U.S. PATENT DOCUMENTS

| | | | |
|---|---|---|---|
| 3,122,761 | 3/1964 | Bouvier | 412/40 |
| 3,125,887 | 3/1964 | Bouvier et al. | 412/40 X |
| 3,793,660 | 2/1974 | Sims | 412/40 |
| 3,816,866 | 6/1974 | Miaskoff et al. | 412/12 |
| 4,607,993 | 8/1986 | Scharer | 412/40 |
| 4,610,590 | 9/1986 | Pigna | 412/13 X |
| 4,844,674 | 7/1989 | Tipps et al. | 412/43 |
| 4,900,211 | 2/1990 | Vercillo | 281/21.1 X |
| 4,902,183 | 2/1990 | Vercillo et al. | 412/7 |
| 4,927,310 | 5/1990 | Abildgaard et al. | 412/7 |

FOREIGN PATENT DOCUMENTS

| | | | |
|---|---|---|---|
| 830636 | 2/1952 | Fed. Rep. of Germany | 412/40 |
| 2362440 | 6/1974 | Fed. Rep. of Germany | 412/40 |

*Primary Examiner*—Paul A. Bell

*Attorney, Agent, or Firm*—Hill, Van Santen, Steadman & Simpson

[57] ABSTRACT

A cartridge system for carrying an edge binder and for use with a binding apparatus is disclosed for use in preparing bound booklets from prepunched sheets, usually paper. The cartridge is constructed to cooperate with the binding apparatus to carry and deliver binders for use in forming a booklet and to indicate to the apparatus as by location of conductive adhesive pads, the contents of the cartridge. Structure on the cartridge can operate the apparatus to control the thickness of delivered prepunched sheets. The apparatus includes a tool for opening the binder, a guide for delivering paper, and a support for the cartridge to deliver the binder. The tool, paper guide and cartridge support are angularly related to each other and to the horizontal.

10 Claims, 3 Drawing Sheets

FIG. 3
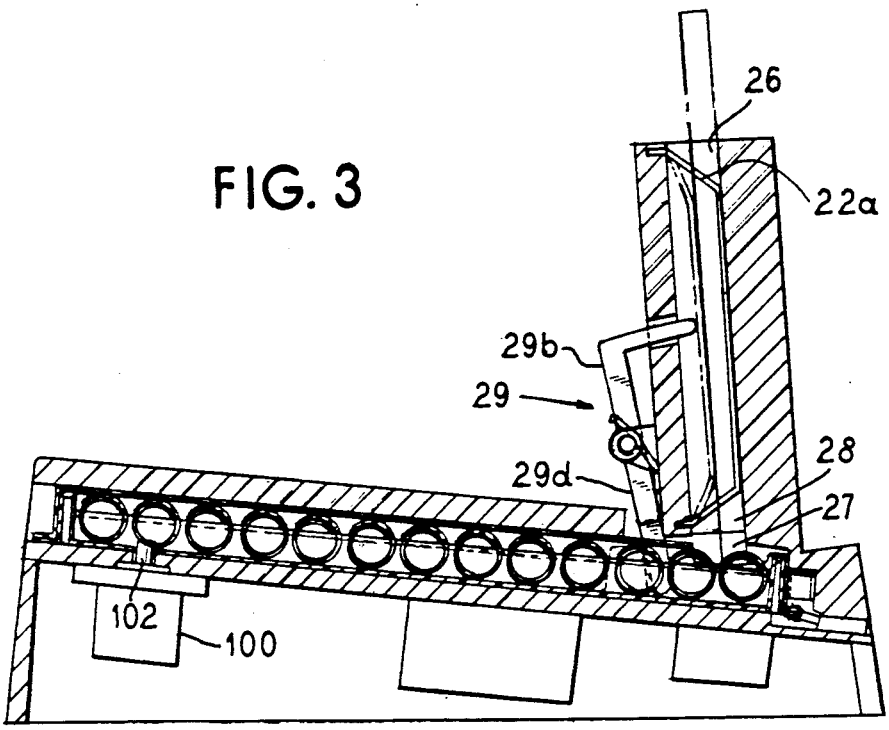
FIG. 5
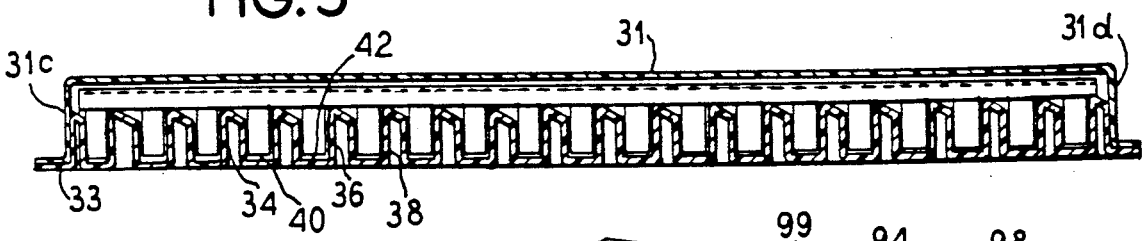
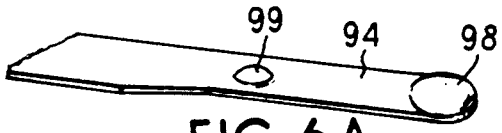
FIG. 6A
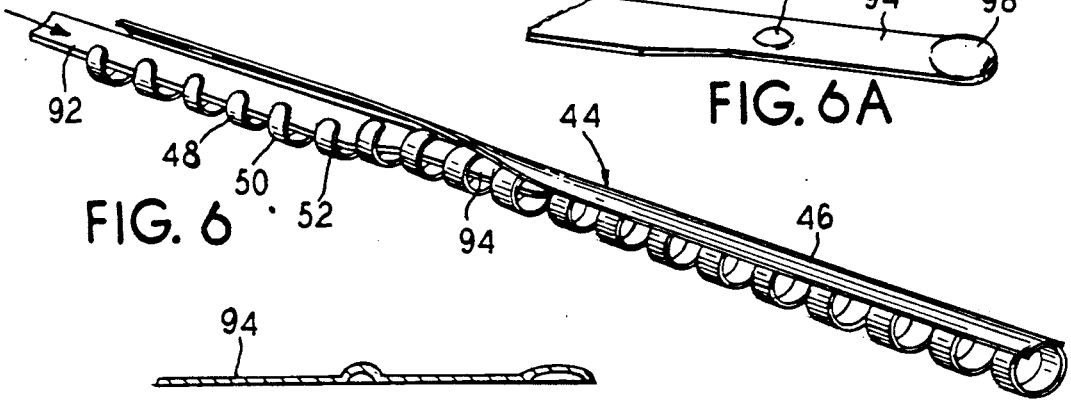
FIG. 6
FIG. 6B

CARTRIDGE SYSTEM FOR TOOL INSERTION TYPE BINDING MACHINE

BACKGROUND OF THE INVENTION

This invention relates to a cartridge for applying curled-finger ring-type edge binders to prepunched paper for forming a booklet, and more particularly, to a cartridge which carries binders and cooperates with an office-style binding apparatus.

The use of plastic curled-finger ring-type edge binders for forming booklets with prepunched materials is known. One class of equipment is the office-style punch-and-binding machine as disclosed in U.S. Pat. Nos. 3,122,761; 3,125,887; 3,227,023; 3,793,660; and 4,645,399. These machines are used to apply ring-type edge binders to prepunched sheets (usually paper) so as to form bound booklets. The ring-type edge binder includes an elongated spine having a plurality of curled fingers spaced therealong. (See, for example, U.S. Pat. No. 1,970,285.) Each finger has one end integral with one edge of the spine and the other end of the finger is free but resiliently engages the other edge of the spine. In prior art machines the binder was held in a comb and L-shaped machine fingers were manipulated to engage the binder fingers and to spread them from the spine so as to open the binder for fitting of prepunched sheets onto the opened fingers and then to close the fingers so as to form the booklet by binding the sheets together with the edge binder.

German Patentschrift 830,636 and German Offenlegungsschrift 2 362 440 disclose a hand-operated tapered editing device which is axially inserted into the end of a binder for spreading the fingers. A U.S. Pat. No. 2,234,045 shows a tapered hand-operated opening device.

In recent developments an improved insertion tool and portable system has been developed for opening a binder and binding a booklet. See also U.S. Pat. No. 4,900,211 and U.S. patent application Ser. No. 346,918 filed May 1, 1989.

In some circumstances, as in an office, heavy-duty, faster and more flexible machines or apparatus are desirable. In order for such binding machines to be effective, they should employ a replaceable binder system from which booklets of different thicknesses and different colors can be formed and bound. This requires the selective use of different diameter and/or different color edge binders. This in turn creates the need to adjust the apparatus in relation to at least the diameter of the binder being used.

Therefore, it is an object of this invention to provide a binder delivery system which is suited for use in forming a booklet and which cooperates with an office-style binding apparatus.

Another object of this invention is to provide a binder delivery system which signals the apparatus so it can adjust for the type of binder to be delivered.

These and other objects of this invention will become apparent from the following disclosure and appended claims.

SUMMARY OF THE INVENTION

There is provided by this invention a replaceable binder system for use with an office-style machine for inserting a tool into a curled-finger ring-type edge binder. The machine can have a paper punching section and a binding section which includes: a support base; a guide for delivering prepunched sheets, usually paper, to a binding position within the machine; a support for receiving a cartridge for binders to be delivered to the binding position; and an internal mechanism aligned with the binding position for storing and advancing the tool to be inserted into the binder so as to open the binder to receive the prepunched paper and close the binder to form a bound booklet. The machine also includes a system to respond to information from the cartridge, such as binder diameter, and accordingly adjust so as to assure proper binding. See application entitled "Automatic Binding Machine Using Insertion Tools", Ser. No. 07/481,852 filed Feb. 20, 1990, for further details regarding the machine.

There is provided herein a binder carrying cartridge wherein a cartridge carries one or more binders of the same size and color. Different cartridges carry different diameter or color binders. However, each cartridge has substantially the same external size and shape. Each cartridge also carries means to communicate to the apparatus the contents of the cartridge, such means can include indicia at various locations, surface configurations, etc.

BRIEF DESCRIPTION OF THE DRAWINGS

FIG. 3 is a side sectional view showing the apparatus and cartridge of this invention;

FIG. 5 is a cross-sectional view of a cartridge of the invention showing the internal structure for supporting a binder;

FIG. 6 is a diagrammatic and perspective view showing the use of an insertion tool to open a binder;

FIG. 6A is a perspective view showing the tip of an insertion tool;

FIG. 6B is a sectional view showing a longitudinal section of the tip of an insertion tool.

DESCRIPTION OF THE PREFERRED EMBODIMENT

In General

Figure 1:
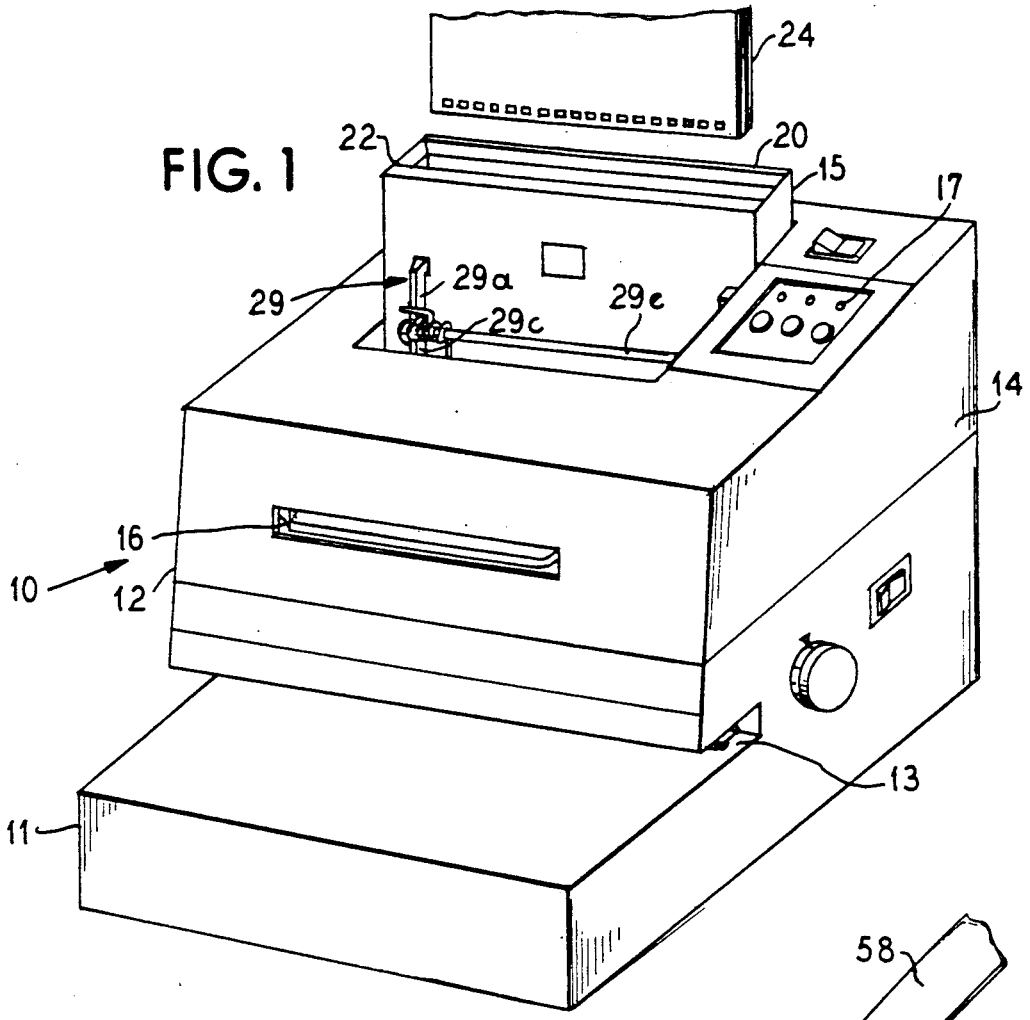
FIG. 1 is a diagrammatic and perspective view of a binding apparatus which employs the invention disclosed herein.

Referring now to the drawings, there is shown diagrammatically in FIG. 1 a binding apparatus 10 generally which includes a base 11, housing 12, a punch section 13, a binding section 14, paper guide 15, binder cartridge receiving slot 16, a control mechanism 17, an internal mechanism which includes a tool storage and extension device and a control mechanism. In the disclosed apparatus the punch section 13 is in the lower portion of the device and is generally of the known type which has been suitably adapted for use herein. When punched, the distance between the side edge and adjacent binding apertures is known as the back gauge distance. This punch has the capability of adjustably controlling that distance.

The binding section 14 is in the upper portion of the machine and includes the paper guide 15, binder cartridge receiving slot 16 and the internal tool advancing and storage mechanism.

PAPER GUIDE

A principal component is the paper guide 15. The guide includes a pair of plates 20 and 22 for guiding prepunched sheets 24, usually paper, to a binding position. The paper is guided between the plates from an entry throat 26 at the top of the guide 15 to an exit throat 28 at the bottom of the guide. The exit throat is adjacent a binding position, shown as 27 generally, at which the prepunched paper is bound together by a ring-type curled-finger edge binder to form a booklet.

For reference purposes, the right-hand direction is considered the rear or away-from-the-user position, and the left-hand direction is considered the forward or toward-the-user position. The guide is slightly tilted rearwardly. The guide plates 20 and 22 are generally stationary or in fixed relation to the base 11. The guide plate 22 includes a plurality of springs, such as 22*a*, for use in positioning and guiding paper and permitting removal of finished booklets. A paper caliper assembly 29 is mounted to the rear plate and has arms that are movable through apertures in the rear plate and against guide springs. The arm includes upper sections 29*a* and 29*b* and lower sections 29*c* and 29*d*. The lower sections are adapted to engage a cartridge for sensing information as to the thickness of the binder and thus paper to be used. A torsion bar and spring assembly 29*e* is used to bias the arms toward the paper engaging position to provide paper thickness adjustment at the entry throat 26 and exit throat 28 and thus permit control of the thickness or amount of prepunched paper entering the binding position, which thickness is related to the binder size or diameter.

The binder-carrying cartridge includes devices such as side protrusions which engage the lower sections 29*c* and 29*d* and adjust the paper thickness in relation to the binder diameter in the cartridge.

The arms are biased to the full closed position by the spring system 29*e*. Moreover, the guide springs, such as 22*a*, which extend from the plate, extend vertically between the exit and entry throats and force the paper against the front plate. Paper positioned therebetween and the plates are spaced apart enough to permit a bound booklet to be withdrawn therefrom with the rings of the binder fitting between the guide springs.

CARTRIDGE

The cartridge 30 carries binders and includes means for interacting with the binding apparatus so as to cooperate with the apparatus in binding booklets and in signalling the apparatus as to the size (i.e., diameter) of the binder carried in the cartridge.

Figure 2:
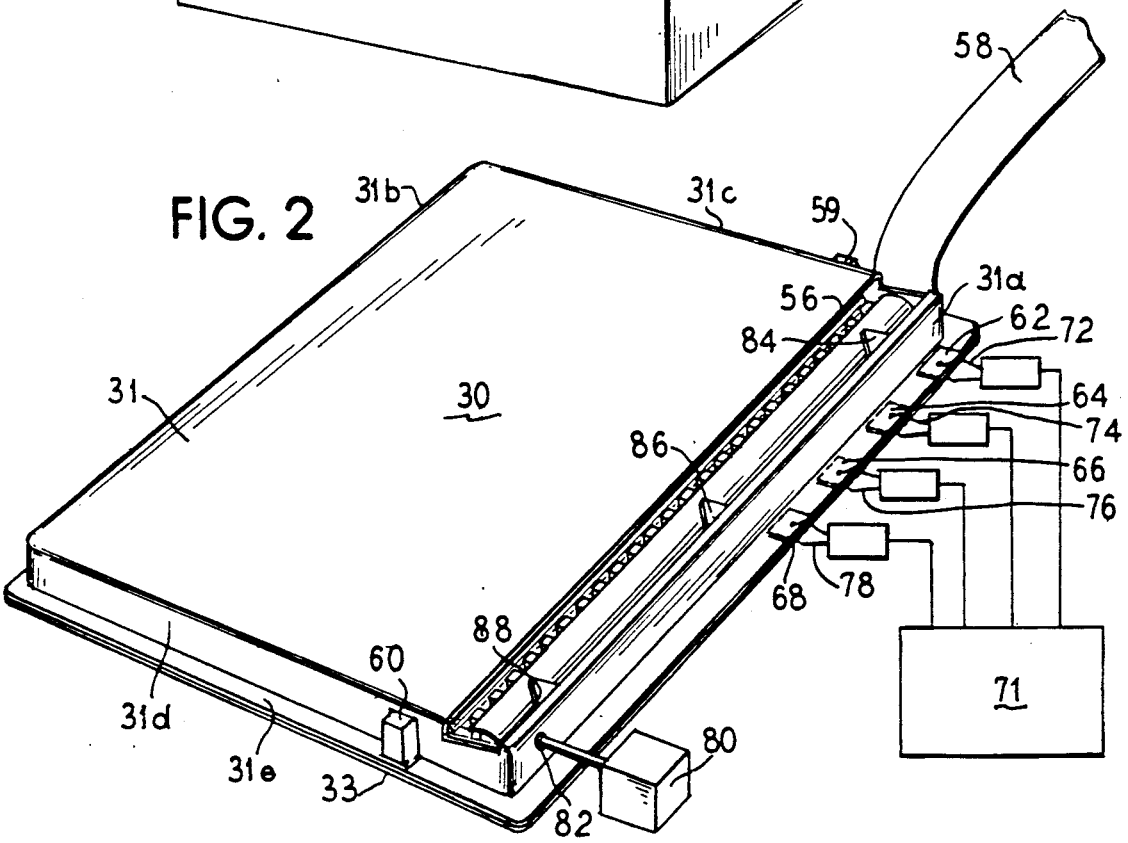
FIG. 2 is a perspective and diagrammatic view of a cartridge for edge binders having the features of this invention.

The cartridge 30 is a vacuum formed, sealed, plastic and box-like assembly. Referring to FIGS. 2 and 5 and the binder carrying function of the cartridge, the cartridge includes a top or cover 31 having a front wall 31*a*, a back wall 31*b*, side walls 31*c* and 31*d*, a peripheral edge 31*e*, and a base 33 which has a plurality of spaced binder supporting ribs, such as 34, 36 and 38, which extend between the front and rear walls 31*a* and 31*b* of the cartridge. The ribs define spaces or channels therebetween such as 40 and 42. Each edge binder, such as 44, includes an elongated spine 46 having a plurality of curled fingers, such as 48, 50 and 52, spaced therealong. One end of each finger is integral with one edge of the spine, and the other end of each finger is free and resiliently biased against the other edge of the spine. The fingers are biased so that the spine overlies the finger free ends.

In the cartridge the binder spine 46 rests on the rib tops with the binder fingers positioned or hanging in the channels between the ribs.

The top portion 31 of the cartridge is vacuum formed to fit over the bottom portion 33 and permit movement of the binders. The top portion 31 is sealed to the bottom portion 33 as, for example, along the peripheral edge such as 31*e*.

Each cartridge fits within the binding apparatus and carries an edge binder of a selected size, for example, ¼ inch diameter and nineteen rings. Each cartridge can also carry binders of only one color. Thus a plurality of separate cartridges may be needed if different size and/or different color edge binders are to be stocked for future use.

The cartridge top defines a binder slot 56 in the top surface adjacent the cartridge front. The opening may be formed with a perforated or tear-away strip 58 that extends from side-to-side of the cartridge. The strip ends and opening are curved so as to extend downwardly along the cartridge sides so as to assure alignment of the opening insertion tool, binder and rib top edges. In other words this downward curvature permits an opening tool to be extended into a binder with the binder within the cartridge.

The cartridge is insertable into the apparatus 10 whereby the binder slot 56 is aligned with the paper guide exit 28.

The cartridge 30 includes paper caliper arms-engaging-protrusion-like structures 59 and 60 positioned on each side for engaging and adjusting the paper caliper arms, such as 29*c* and 29*d*, to receive paper of a thickness that can cooperate with the binders in a cartridge. In this embodiment the cartridge has protrusions, such as 59 and 60, that are constructed and positioned to engage the lower end of the pivotable paper caliper arms 29*c* and 29*d* so as to move the arms and adjust the exit opening 28 to pass paper having a thickness suitable to be bound by the binder in the cartridge. The following table sets forth desirable binding characteristics:

| Binder Diameter (Nominal) | Paper Thickness (Nominal) |
|---|---|
| 5/16" | .125" |
| ⅜" | .245" |
| ½" | .345" |
| ⅝" | .444" |
| ¾" | .562" |

The protrusions are spaced rearwardly from the front of the cartridge a distance effective to contact the lower edge of the caliper arms 29*c* and 29*d* and allow only a predetermined thickness of paper to pass to the binding position. The rearward positioning of the protrusions can be varied, forwardly or rearwardly of the shown position, in order to pass less or more paper in relation to the binder sizes.

Moreover, the cartridge includes readable structure which can be detected by the binding apparatus so as to indicate the contents of the cartridge.

For example, one or more conductive adhesive tabs, such as 62, 64, 66 and 68, can be located on the front edge of a cartridge to indicate binder content information such as diameter, etc. The tabs can be positioned to contact different circuit elements in the binding apparatus and thus issue a signal that in turn communicates with a device, such as in a programmed microprocessor, regarding operation of the apparatus as a function of the binder diameter.

Different cartridge contents could be indicated by the position of the tab at different locations, such as 64, whereby different circuit elements can be activated to signal the binding apparatus that a different diameter binder is being used.

It is to be appreciated that many different types of encoding devices can be used, such as the conductive adhesive tab, detents, optical codes, etc.

THE READING SYSTEM

With reference to FIG. 2, note that diagrammatically a cartridge 30 interfaces with a "reading" device, which can include fingers, such as 72, 74, 76 and 78, and communicates with a control system 71 that, in turn, controls the operation of the binding apparatus 10.

BINDER SENSOR

It is important that the machine can detect the presence of a binder at the binding position within the cartridge. Referring to FIG. 2, a sensor 80 is shown which is aligned with a cartridge aperture 82 in the front wall of the cartridge for sensing the presence or absence of a binder. The sensing is shown herein as a mechanical system but can be electrical or optical.

BINDER RETENTION SYSTEM

After the cartridge has been opened, it is desirable to exert a slight force on the binder at the binding position so as to retain the binder thereat, while still permitting a binder to be removed from the cartridge. Tabs 84, 86 and 88 are provided in the cartridge to achieve this.

THE CARTRIDGE/SOLENOID SYSTEM

In the operation of this system, it is also important to be certain that the cartridge is locked in position in the machine. This is done using a solenoid system 100 that includes a plunger 102 that engages and locks the cartridge and acts as a sensor as to the presence of the cartridge.

THE INSERTION TOOL MECHANISM

A typical binder opening tool 90 is shown in FIG. 6. The tool is rigid when extended, has a wide but straight body 92, and a narrow tapered front end or leader 94. Leader incorporates a spherical form 98 at its very end to insure smooth entry into the binder. A second form 99 acts as a stop to prevent the tool from being fully retracted into the tool housing. The tool is axially inserted into the binder, separates the free ends of the fingers and the spine so as to form a paper receiving gap and rotates the binder spine to a generally vertical position with the gap and is positioned to face upwardly so as to receive prepunched paper therein.

The timing of the tool operation (i.e., insertion and withdrawal) and selection of the appropriate width tool so as to match the binder diameter is related to the encoding provided on the cartridge.

Figure 4:
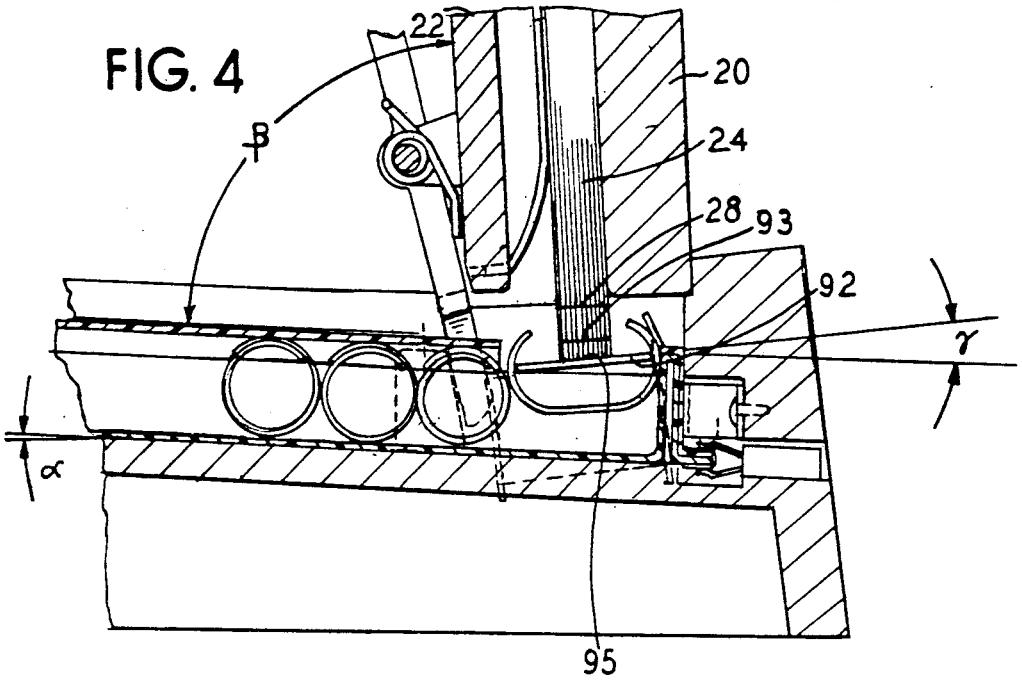
FIG. 4 is an enlarged side view of a binding position for the binding apparatus.
Figure 7:
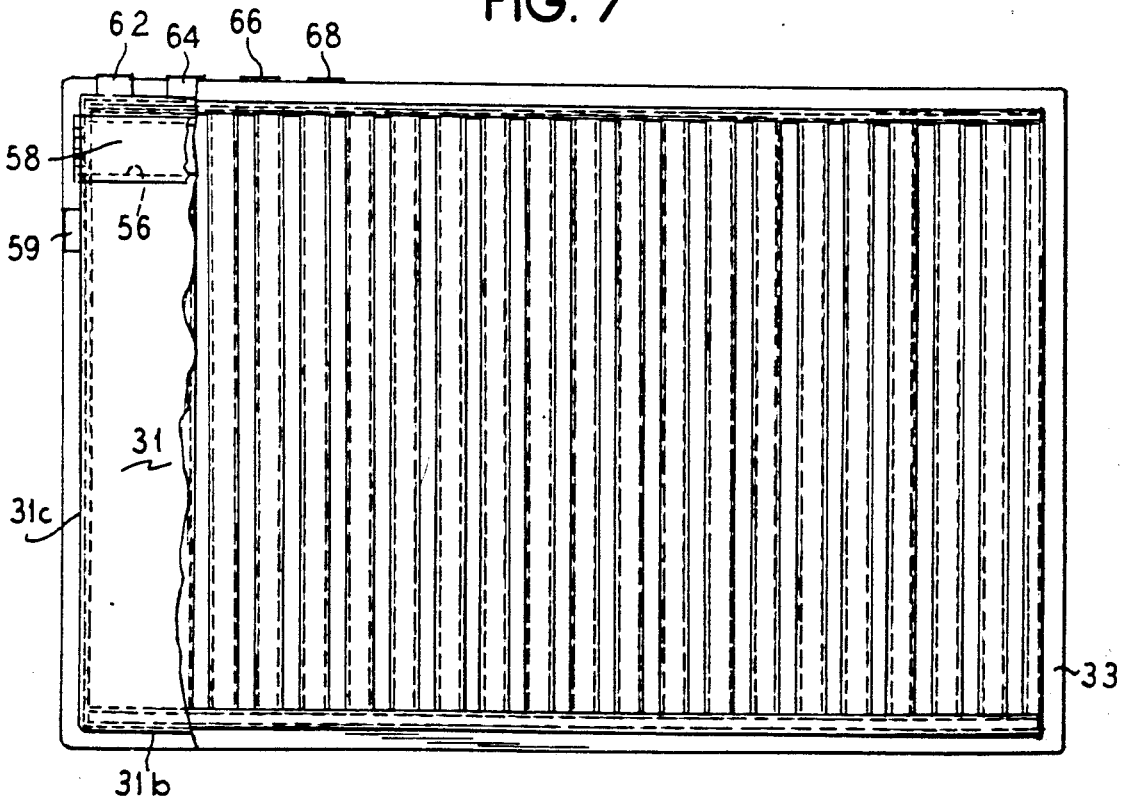
FIG. 7 shows a plan view of the cartridge.

Moreover, the tool is aligned with the cartridge and binder to assure entry of the tool into a binder in the cartridge but at a point along the cartridge rib top at the top of the cartridge side walls. This is best seen in FIG. 4.

ALIGNMENT

Alignment of the several main components, particularly at the binding positions, is important.

The cartridge is aligned at a small angle, alpha ($\alpha$), for example, 5° to the horizontal and is tilted forwardly and downwardly toward the binding position. This alignment is to give a gravity assist to binders moving downwardly in the cartridge and to assure proper binder alignment with paper at the binding position.

The paper guide is generally vertical but slightly tilted relative to the binding position at an angle beta ($\beta$), usually about 82° to the cartridge. This is to assure alignment between the paper, the prepunched apertures in the sheets and the free ends of binder fingers. This is to permit the binder fingers to resiliently snap through the apertures when the fingers are released by withdrawal of the insertion tool. In this particular embodiment the paper guide is tilted at 87° to the horizontal and therefore there is an included angle of 82° between the cartridge and paper guide.

The opening tool 92 lies in a plane rearwardly tilted at an angle gamma ($\gamma$) of about 7° to the horizontal and may be considered to have a slight downward slope. The angle between the tool plane and paper guide is 94° (i.e., $82°+5°+7°$).

In the alignment an important factor to consider is the interrelationship between the paper guide, tool and binder. It is seen that the tool opens the binder and positions it in a least force position where the suitable opening can be achieved. The paper edge rests on the tool at an angle effective to assure snapping of the binder fingers through the paper apertures. Moreover, the positioning of the paper apertures with respect to the paper edge, also known as the back gauge, is selected so as to assure alignment of the fingers relative to the aperture when the paper is in the binder.

The particular angular relationship is unique to the binder used, in this case a $\frac{5}{8}''$ binder. However, other binders in the $\frac{1}{4}''-\frac{3}{4}''$ in diameter range also use the same relationship.

OPERATION

It is to be noted that when the cartridge was fitted into the binding apparatus the cartridge protrusions 59 and 60 engage the lower end of the paper calipers **29*c* and 29*d* so as to adjust the amount of paper at the exit opening 28. For convenience, caliper arms are biased to the closed position by the spring construction 29*e***.

The binding operation is shown in greater detail in FIG. 4. There it is seen that the tool 92 is inserted into a binder 44. The tool opens the binder by spreading the fingers and spine, causes the spine to rotate from a generally horizontal position to a generally vertical position, and may support prepunched paper in position relative to the binder fingers for binding. Prepunched paper, such as 24 in FIG. 4, which has binding apertures 93 at a predetermined distance (i.e., back gauge) from an edge 95, rests on its edge on the tool 92. It is to be noted that the curled fingers, such as 48, 50 and 52, are initially fitted under the spine 46, respectively, and then snap closed through the apertures and come to rest under the spine.

Moreover, it is to be noted that the paper guide and cartridge are at an acute ($\beta$) angle with respect to one another. As explained above, the selection of this angle is important so as to assure alignment of the paper apertures when resting on the tool relative to the binding fingers. The angle between the tool and paper guide is about 94° (i.e., alpha+beta+gamma or 5°+82°+7°).

The binding apparatus can be operated in the following way. The cartridge 30 is inserted into the binding apparatus as shown in FIG. 1. It is seen that the cartridge binding slot is in a lower position and aligned with the paper exit 28. The downward slant to the cartridge assists binders within the cartridge to slide by gravity to the binding position. In the binding position the conductive tab, such as 64, is located and read by an appropriate circuit element (72, 74, 76 or 78). Based upon the information from the reading, a microprocessor in the binding apparatus control system initiates operation of the tool cartridge by advancing the tool into a binder in the binding position so as to open the binder. The tool is retained in the advanced position for a predetermined time sufficient to permit prepunched papers to be dropped through the guide into the opened binder. Then the advanced tool is retracted and the binder snaps closed onto the paper so as to bind the same together as the tool retracts from the binder and into the tool cassette.

After binding is completed and the tool is retracted, the bound booklet is removed through the paper guide 15.

Thereafter, the next binder slides within the cartridge to the binding position for the next binding operation.

From the foregoing, it is seen that in the binding apparatus herein the binder carrying cartridge has many functions in relation to the machine.

Although the invention has been described with respect to preferred embodiments, it is not to be so limited as changes and modifications can be made which are within the full intended scope of the invention as defined by the appended claims.

I claim as my invention:

1. A cartridge and ring-type edge binder in combination for use in a binding machine which binds prepunched sheets with a curled-finger ring-type edge binder so as to form booklet-type assembly, wherein the combination includes:

at least one ring-type edge binder which comprises:

an elongated spine; and a plurality of fingers spaced along said spine, each finger having one end integral with an edge of the spine and a free end which is resiliently biased toward and adjacent said spine; and a cartridge for carrying a ring binder, said cartridge comprising:

means defining top, bottom, side, front and back walls;

means associated with said bottom wall defining a plurality of spaced rib-like members which extend between the front wall and the back wall, each of said rib-like members having a top surface and a finger receiving recess therebetween so that an edge binder can be carried in the cartridge with the spine resting on the top surface and fingers extending into said finger receiving recess; and means associated with said cartridge so as to indicate the type of binder in the cartridge for use in instructing a machine in operation.

2. A cartridge and binder combination as in claim 1, wherein said binder is substantially circular in diameter.

3. A cartridge and binder combination as in claim 1, wherein said indicating means is electrically conductive.

4. A cartridge and binder combination as in claim 3, wherein said indicating means is an electrically conductive adhesive member.

5. A cartridge and binder combination as in claim 1, wherein said binder is shaped such that said spine overlaps the free ends of said fingers and the free ends of said fingers are positioned inwardly of said spine.

6. A cartridge and binder combination as in claim 1, wherein said cartridge includes means defining a slot in said top wall adjacent said front wall.

7. A cartridge and binder combination as in claim 6, wherein the slot extends down the cartridge side walls so as to expose at least the spine of a binder resting on rib tops at the slot.

8. A cartridge and binder combination as in claim 1, wherein said cartridge includes means for indicating to a machine adjustment for a paper guide relative to the thickness of paper to be delivered.

9. A cartridge and binder combination as in claim 8, wherein said guide adjusting means includes means protruding from the top surface of the cartridge for engaging a binding machine.

10. A cartridge and binder combination as in claim 1, wherein said cartridge has a top surface spaced from the cartridge top and sloped downwardly and forwardly.

* * * * *